US005696546A

United States Patent [19]

Narang et al.

[11] Patent Number: 5,696,546

[45] Date of Patent: Dec. 9, 1997

[54] INK SUPPLY CARTRIDGE WITH INK JET PRINTHEAD HAVING IMPROVED FLUID SEAL THEREBETWEEN

[75] Inventors: Ram S. Narang, Fairport; Stephen F. Pond, Pittsford, both of N.Y.

[73] Assignee: Xerox Corporation, Stamford, Conn.

[21] Appl. No.: 425,270

[22] Filed: Apr. 17, 1995

Related U.S. Application Data

[63] Continuation of Ser. No. 151,622, Nov. 15, 1993, abandoned.

[51] Int. Cl.[6] ..... B41J 2/175

[52] U.S. Cl. ..... 347/87

[58] Field of Search ..... 347/86, 87, 65; 156/273.5; 525/404

[56] References Cited

U.S. PATENT DOCUMENTS

| | | | |
|---|---|---|---|
| 3,903,048 | 9/1975 | Lombardi et al. | 528/90 |
| 4,095,237 | 6/1978 | Amberntsson | 346/140 R |
| 4,419,678 | 12/1983 | Kasugayama et al. | 346/140 R |
| 4,463,359 | 7/1984 | Ayata et al. | 346/1.1 |
| 4,771,295 | 9/1988 | Baker et al. | 346/1.1 |
| 4,774,530 | 9/1988 | Hawkins | 346/140 R |
| 4,791,438 | 12/1988 | Hanson et al. | 346/140 R |
| 5,086,307 | 2/1992 | Noguchi et al. | 347/65 |
| 5,221,397 | 6/1993 | Nystrom | 156/273.5 |
| 5,233,369 | 8/1993 | Carlotta et al. | 346/140 R |
| 5,252,694 | 10/1993 | Willett et al. | 525/404 |
| 5,289,212 | 2/1994 | Carlotta | 347/87 |

OTHER PUBLICATIONS

Xerox Disclosure Journal, vol. 16, No. 4, Jul./Aug. 1991, p. 233.

*Primary Examiner*—N. Le

[57] ABSTRACT

An ink cartridge for an ink jet printer has an ink supply in a housing and a printhead assembly fixedly attached thereto. The ink is contained in an absorbent material in the housing which is partitioned from the printhead assembly by a housing floor having a vent and an ink outlet. The ink flow path from the housing outlet to the printhead inlet is produced by an elongated recess in the outer surface of the housing floor and a film member bonded thereover by an adhesive not attacked or eroded by the ink. The film member has a slot therethrough to provide communication with the inlet of the printhead. The surface of the film member opposite the surface bonded to the housing floor is coated with a thermosetting adhesive which bonds to the printhead assembly surface containing the ink inlet. The printhead assembly ink inlet is of similar size and aligned with the film member slot, so that the thermosetting adhesive assists in the attachment of the printhead assembly to the housing and concurrently provides the fluid seal between the housing and the printhead assembly. The adhesive bonding the film member to the housing floor is either a pressure sensitive adhesive or the same thermosetting as is sued on the other side of the film member.

8 Claims, 5 Drawing Sheets

INK SUPPLY CARTRIDGE WITH INK JET PRINTHEAD HAVING IMPROVED FLUID SEAL THEREBETWEEN

This is a continuation of application Ser. No. 08/151,622, filed Nov. 15, 1993 abandoned.

BACKGROUND OF THE INVENTION

This present invention relates to a cartridge for supplying liquid ink to a printhead in a thermal ink jet printing apparatus, and, more particularly, to an ink supply cartridge having a housing containing ink, a printhead fixedly attached to the housing, and a fluid seal between the printhead inlet and housing outlet.

In existing thermal ink jet printing, the printhead comprises one or more ink filled channels, such as disclosed in U.S. Pat. No. 4,774,530, communicating with a relatively small ink supply chamber or manifold, at one end and having an opening at the opposite end, referred to as a nozzle. A thermal energy generator, usually a resistor, is located in each of the channels, a predetermined distance from the nozzles. The resistors are individually addressed with a current pulse to momentarily vaporize the ink and form a bubble which expels an ink droplet. As the bubble grows, the ink bulges from the nozzle and is contained by the surface tension of the ink as a meniscus. As the bubble begins to collapse, the ink still in the channel between the nozzle and resistor starts to move towards the collapsing bubble, causing a volumetric contraction of the ink at the nozzle and resulting in the separation of the bulging ink as a droplet. The acceleration of the ink out of the nozzle while the bubble is growing provides the momentum and velocity of the droplet in a substantially straight line direction towards a recording medium, such as paper. Because the droplet of ink is emitted only when the resistor is actuated, this general type of thermal ink jet printing is known as "drop-on-demand" printing.

The printhead of U.S. Pat. No. 4,463,359 has one or more ink-filled channels which are replenished by capillary action. A meniscus is formed at each nozzle to prevent ink from weeping therefrom. A resistor or heater is located in each channel upstream from the nozzles. Current pulses representative of data signals are applied to the resistors to momentarily vaporize the ink in contact therewith and form a bubble for each current pulse. Ink droplets are expelled from each nozzle by the growth and collapse of the bubbles. The current pulses to the heater are shaped to prevent the meniscus from breaking up and receding too far into the channels after each droplet is expelled. Various embodiments of linear arrays of thermal ink jet devices are known, such as those having staggered linear arrays attached to the top and bottom of a heat sinking substrate and those having different colored inks for multiple colored printing.

In current practical embodiments of drop-on-demand thermal ink jet printers, it has been found that the printers work most effectively when the pressure of the ink in the printhead nozzle is kept within a predetermined range of gauge pressures. Specifically, at those times during operation in which an individual nozzle or an entire printhead is not actively emitting a droplet of ink, it is important that a certain negative pressure, or "back pressure," exist in each of the nozzles and, by extension, within the ink supply manifold of the printhead. A discussion of desirable ranges for back pressure in thermal ink jet printing is given in the "Xerox Disclosure Journal," Vol. 16, No. 4, July/August 1991, p. 233. This back pressure is important for practical applications to prevent unintended leakage, or "weeping," of liquid ink out of the nozzles onto the copy surface. Such weeping will obviously have adverse results on copy quality, as liquid ink leaks out of the printhead uncontrollably.

A typical end-user product in this art is a cartridge in the form of a prepackaged, usually disposable item comprising a sealed container holding a supply of ink and, operatively attached thereto, a printhead having a linear or matrix array of channels. Generally the cartridge may include terminals to interface with the electronic control of the printer; electronic parts in the cartridge itself are associated with the ink channels in the printhead, such as the resistors and any electronic temperature sensors, as well as digital means for converting incoming signals for imagewise operation of the heaters. In one common design of printer, the cartridge is held with the printhead in close proximity to the sheet on which an image is to be rendered, and is then moved across the sheet periodically, in swaths, to form the image, much like a typewriter. Full-width linear arrays, in which the sheet is moved past a linear array of channels which extends across the full width of the sheet, are also known. Typically, cartridges are purchased as needed by the consumer and used either until the supply of ink is exhausted, or, equally if not more importantly, until the amount of ink in the cartridge becomes insufficient to maintain the back pressure of ink to the printhead within the useful range.

Other considerations are crucial for a practical ink supply as well. The back pressure, for instance, must be maintained at a usable level for as long as possible while there is still a supply of ink in an ink cartridge. Therefore, a cartridge must be so designed as to maintain the back pressure within the usable range for as large a proportion of the total range of ink levels in the cartridge as possible. Failure to maintain back pressure causes the ink remaining in the cartridge to leak out through the printhead or otherwise be wasted.

U.S. Pat. No. 4,095,237 discloses an ink supply to a movable printing head in which a flow path is located in the flow path of a liquid reservoir of ink in communication with the printhead. The disclosed material for the filter is foam rubber or foam plastic. The printhead is raised higher than the outlet port of the reservoir.

U.S. Pat. No. 4,419,678 discloses a modular ink supply system for an ink jet printer wherein a liquid ink supply container is inserted into the printing apparatus, and communicating tubes puncture the container to form a tight seal against the outlet port and ventilation port of the container.

U.S. Pat. No. 5,233,369 discloses an ink-supply cartridge wherein two chambers are provided, the upper chamber having a capillary foam and the lower chamber substantially filled with ink. The printhead is disposed at a vertical height greater than the top level of the lower chamber. A second capillary foam, disposed along the supply line to the printhead, has a capillarity greater than that of the foam in the upper chamber. In another embodiment, only one chamber, corresponding to the lower chamber in the first embodiment and having no capillary foam therein, is provided.

U.S. Pat. No. 4,771,295 discloses an ink-supply cartridge construction having multiple ink storage compartments. Ink is stored in a medium of reticulated polyurethane foam of controlled porosity and capillarity. The medium empties into ink pipes, which are provided with wire mesh filters for filtering of air bubbles and solid particles from the ink. The foam is also compressed to reduce the pore size therein, thereby reducing the foam thickness while increasing its density; in this way, the capillary force of the foam may be increased.

U.S. Pat. No. 4,791,438 discloses an ink jet pen (ink supply) including a primary ink reservoir and a secondary ink reservoir, with a capillary member forming an ink flow path between them. This capillary member draws ink from the primary reservoir toward the secondary ink reservoir by capillary action as temperature and pressure within the primary reservoir increases. Conversely, when temperature and pressure in the housing decreases, the ink is drawn back toward the primary reservoir.

SUMMARY OF THE INVENTION

In accordance with one aspect of the present invention, a cartridge for supplying liquid ink to a thermal ink jet printing apparatus comprises a housing defining a single chamber having a floor with a ventilation port and an outlet port covered by a filter. An absorbent medium occupies at least a portion of the chamber, the absorbent medium being adapted to retain a quantity of liquid ink. A scavenger member of absorbent material is disposed across the outlet port, providing a capillary force greater than that of the absorbent medium. An ink passageway is formed when an elongated recess in the external surface of the housing floor is covered by a shaped thin polyester film having a predetermined geometry and an adhesive on both sides. The film adhesive contacting the housing floor and covering the floor recess is a pressure sensitive tape and the adhesive on the opposite side is a thermosetting type. A small slot in the shaped film serves as an outlet from the passageway and is aligned with and seals the printhead inlet. The printhead is bonded to a heat sink which is, in turn, fixed to the cartridge floor by ultrasonically staking posts which extend through locator holes in the heat sink. The posts are also used to align the printhead inlet with the shaped film slot. After the posts are staked to fix the heat sink and printhead to the cartridge floor, the thermosetting adhesive sandwiched between the polyester film and the printhead is cured to form a permanent fluid seal around the slot in the shaped film and the printhead inlet. The thermosetting adhesive is a combination of bisphenol A epoxy, V40® curing agent, and polymeric dialkoxyalkyl-aminosilanes, such as PSO76.5, as adhesion promoter.

BRIEF DESCRIPTION OF THE DRAWINGS

By way of example, an embodiment of the invention will be described with reference to the accompanying drawings, wherein like numerals indicate like parts, in which.

DESCRIPTION OF THE PREFERRED EMBODIMENT

Figure 1:
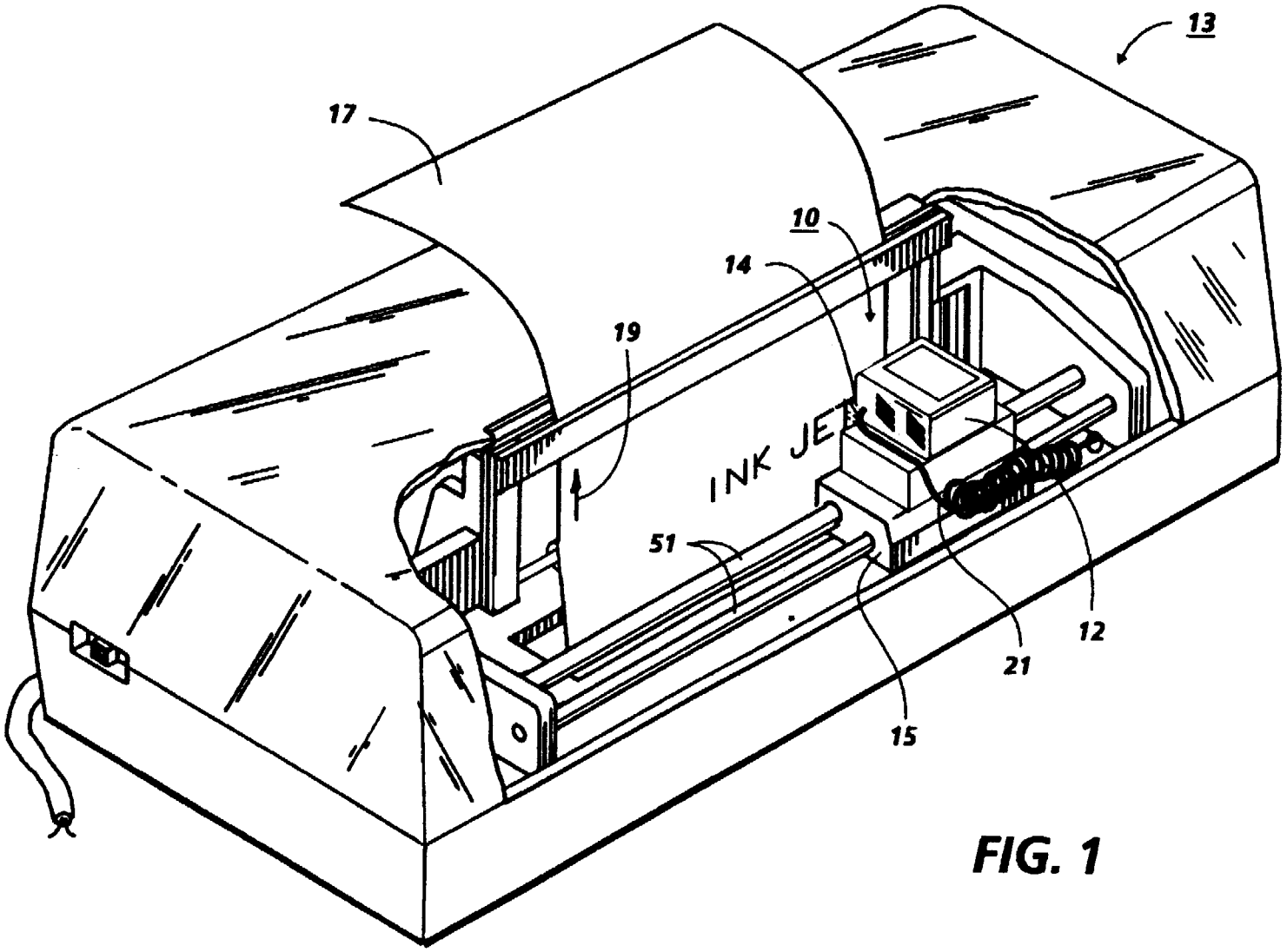
FIG. 1 is an isometric view of a thermal ink jet printer having the ink supply cartridge of the present invention.

FIG. 1 is a schematic isometric view of a type of thermal ink jet printer 13 in which the printhead 14 and the ink supply therefor are combined in a single package, referred to hereinafter as cartridge 10. The main portion of cartridge 10 is the ink supply contained in housing 12, with another portion forming the actual printhead 14. In this embodiment of the invention, cartridge 10 is installed in a thermal ink jet printer 13 on a carriage 15 which is translated back and forth across a recording medium 17, such as, for example, a sheet of paper, on guide rails 51. During the translation of the printhead 14 by the carriage 15, the printhead moves relative to sheet 17 and prints characters on the sheet 17, somewhat in the manner of a typewriter. In the example illustrated, printhead 14 is of such a dimension that each translation of cartridge 10 along sheet 17 enables printhead to print with a swath defined by the height of the array of nozzles in printhead and the width of the sheet. After each swath is printed, sheet 17 is indexed (by means not shown) in the direction of the arrow 19, so that any number of passes of printhead 14 may be employed to generate text or images onto the sheet 17. Cartridge 10 also includes means, generally shown as cable 21, by which digital image data may be entered into the various heating elements (not shown) of printhead 14 to print out the desired image. This means 21 may include, for example, plug means which are incorporated in the cartridge 10 and which accept a bus or cable from the data-processing portion (not shown) of the apparatus, and permit an operative connection therefrom to the heating elements in the printhead 14.

Figure 3:
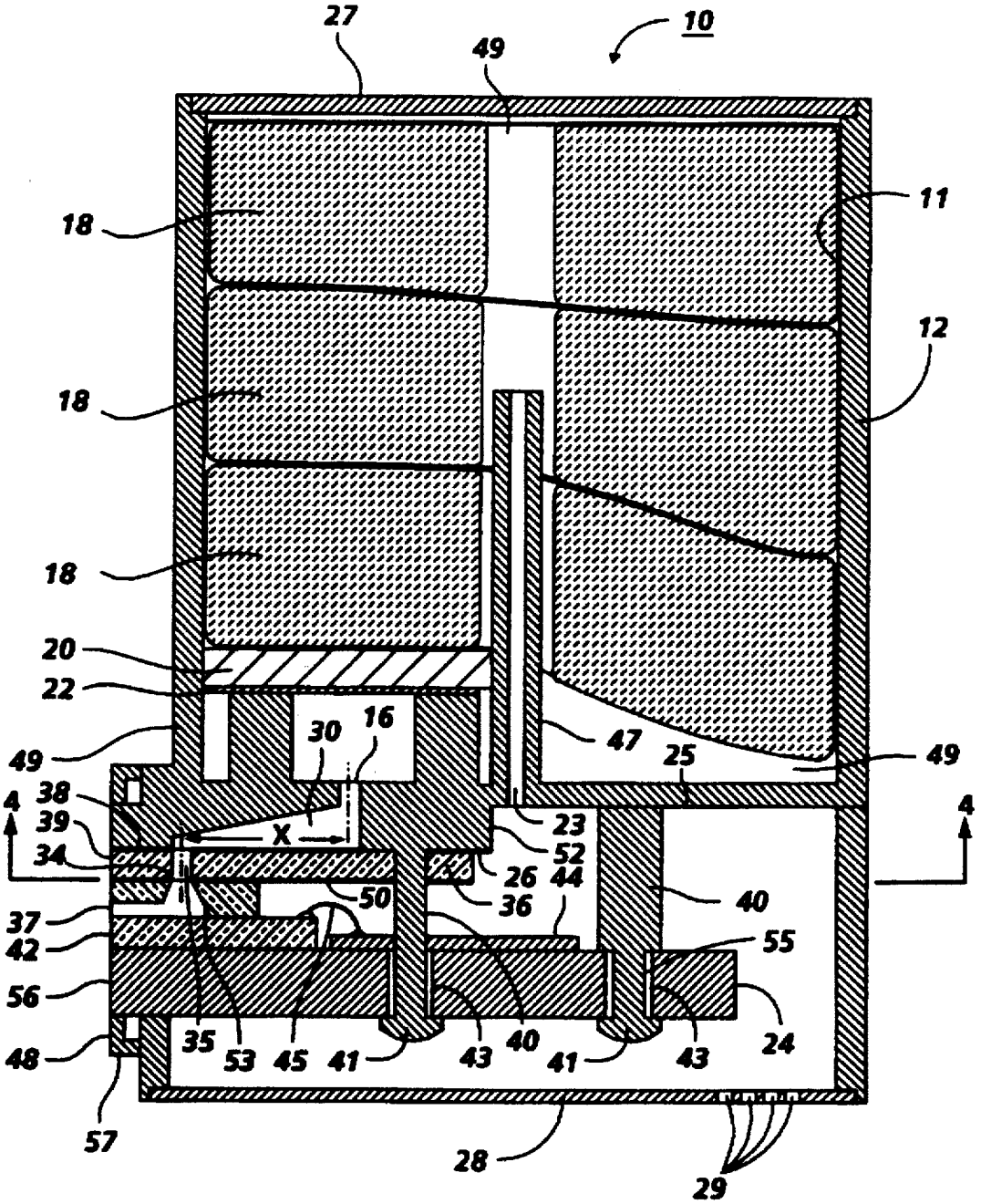
FIG. 3 is a schematic, cross-sectional elevation view of the cartridge in FIG. 2.

FIG. 3 is a schematic sectional, elevational view of cartridge 10. The cartridge 10 has a main portion in the form of a housing 12. Housing 12 is typically made of a lightweight but durable plastic. Housing 12 defines an internal chamber 11 for the storage of liquid ink having a floor 25 with a ventilation port or vent 23, open to the atmosphere, and an output port or outlet 16. An elongated recess or trench 30 is formed in the outer floor surface 26 of the thicker portion 52 of the floor 25, and may be integrally molded in the chamber surface concurrently with the fabrication of the housing 12. One end of the elongated recess 30 is connected to the outlet 16 and the other end terminates at a location which will align with the inlet 34 of the printhead when it is attached to the chamber floor 25. The distance from the center of the outlet 16 to the center of the printhead inlet 34 is about 10 mm. A relatively thin film member 36, having a predetermined shape and a slot 35 therethrough, is bonded to the floor surface 26, covering the elongated recess 30. The slot 35 is substantially the same size as the printhead inlet. The film member has opposing surfaces 31, 33, shown in FIG. 6, with the surface 31 of the film member 36 coated with a pressure sensitive adhesive 38. The other film member surface 33 is coated with a thermosetting adhesive 50, such as, for example, a bisphenol A epoxy with V40® curing agent and adhesion promoter formulated as follows:

| | |
|---|---|
| Solvent: | 30:70 mixture (by wt) of methyl-iso-butyl ketone and xylene |
| Resin: | 1001F |
| Curing Agent: | V40 ® |
| Ratio of curing agent to resin: | 1:3 |
| Ratio to solvent mixture to resin + curing agent mixture | 1:3 |

In addition to its ease of dispensing, this adhesive can be cured either at room temperature in two hours or in as little as 10 minutes by raising the temperature to only 65° C. and first coating the surface of the parts to be bonded with the adhesion promoter PSO76.5®, which is a polymeric dimethoxymethylpropylsilane from Petrarch Chemicals.

The film member 36 is bonded against the bottom or outer surface 26 of the housing chamber floor 25 with any suitable pressure sensitive adhesive 38 on surface 31 of the film member or, optionally, bonded to the housing floor with same thermosetting adhesive 50 which is on the film member surface 33. The film member is shaped to fit the irregular floor surface 26 and to avoid the locating and fastening pins 40 integrally formed or molded with the housing and used to fixedly attach the printhead 14 and heat sink 24, as discussed later. The elongated recess 30 is hermetically sealed by the film member to form a closed ink passageway from the cartridge chamber 11 to the printhead nozzles 37.

Figure 7:
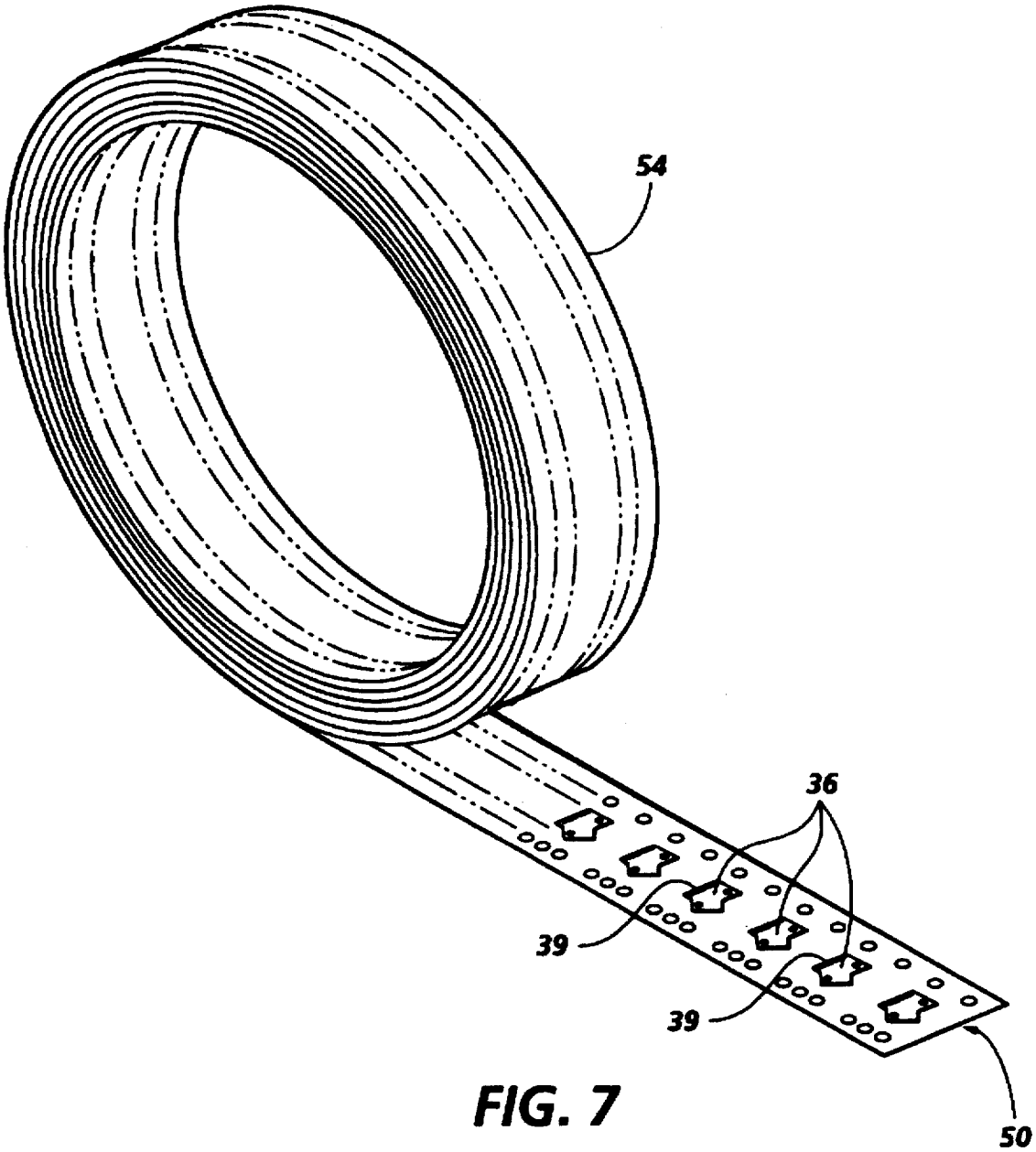
FIG. 7 is a schematic, isometric view of a roll of carrier strip containing a plurality of shaped film members releasably held thereon.

The film member is fabricated by coating the desired adhesive on both sides of a long strip of polyester film, such as Mylar®, having a thickness of about 7 mils. The adhesive on the surface 31 of the film strip is then laminated to a 4 mils thick polyester release carrier strip 50 (FIG. 7) on the side which will bond to the chamber floor and with a thinner polyester release cover (not shown) on the other side, which has a thickness of about 1.5 mils. A progressive punching operation is used to first punch through the critical features of ink slot 35 and front edge 39 which is coplanar with the printhead nozzle face 42 and then the remaining profile or periphery of the film member is just scored to a depth of only 1 mil into the 4 mil polyester release carrier. The scrap material is then removed leaving a complete film member with thinner release cover thereover spaced every 1.5 inches down a 4,000 inch long polyester carrier strip. The reel of scored film members are fed into a pick and place zone of a robotic device (not shown) and the film members are vacuum picked off the carrier strip, positioned to the housing floor surface 26 using a vision system (not shown), and placed onto the housing floor surface with a specified pressure by the robotic device. The top thinner release cover is then removed with a higher tack tape or mechanical picker (neither shown) and the printhead and heat sink assembly is aligned and placed onto the awaiting film member. The printhead 14 is bonded to the heat sink 24, so that the printhead inlet 34 is facing in a direction perpendicular to the heat sink. A printed circuit board 44 is also bonded to the heat sink adjacent the printhead. The terminals or contact pads (not shown) of the printhead 14 and circuit board 44 are interconnected by wire bonds 45. Locating holes 43 in the heat sink are used when mounting the heat sink 24 with printhead 14 and circuit board 44 bonded thereto to align the printhead inlet and nozzle face relative to the housing by inserting the housing stake pins 40 therein. Stake pins 40 are then ultrasonically staked to form pin heads 41 and the attachment of the printhead and heat sink assembly is complete. Optionally, the stake pins may be bonded to locating holes 43 in addition to being staked.

The wire bonds 45 are encapsulated with a thermally curable passivation material (not shown) by, for example, an injection syringe, which fills the cavity behind the printhead and covers the wire bonds. The housing and attached heat sink with printhead and circuit board is cured in an oven, thus simultaneously curing the thermosetting adhesive 50 and the wire bond encapsulating passivation material. Cosmetic bottom cover 28 with ventilation openings 29 is positioned on the housing over the printhead and heat sink assembly and ultrasonically welded to the housing. The nozzle face 42 of the printhead 14 is coplanar with the heat sink 24 and a portion of the upper edge of the housing chamber floor 25. This region of the cartridge 10 is covered by a rectangular shaped frame 48 having a lip 57 around the outer edge thereof and extending in a direction towards the housing. The void area between the frame and the housing is filled with another passivation material (not shown) to form a hermetic seal completely around the printhead.

Figure 2:
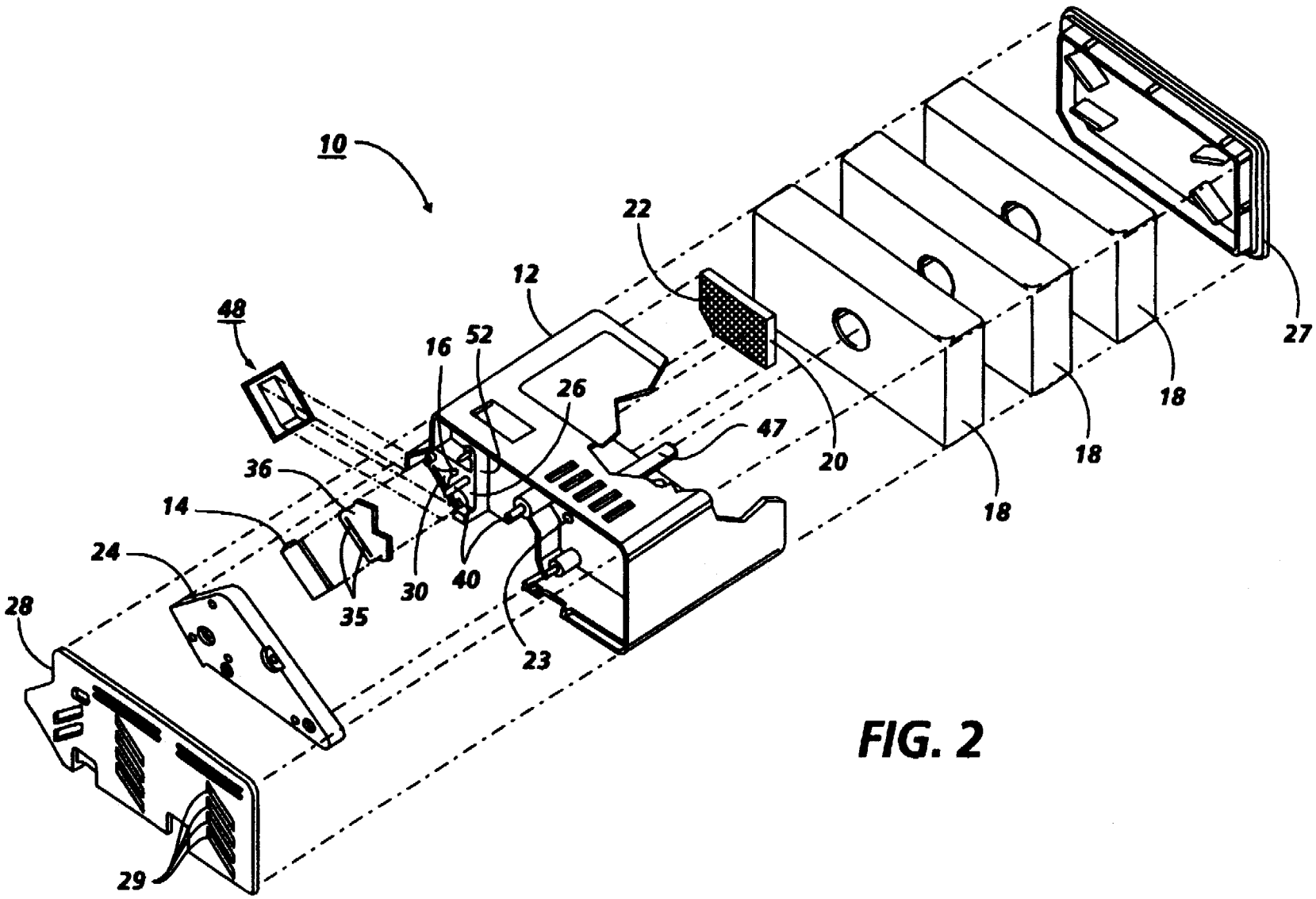
FIG. 2 is an exploded view of the ink supply cartridge of FIG. 1, showing the shaped film that concurrently completes the ink flow passage from the outlet in the cartridge floor to the printhead inlet and the adhesive on the shaped film provides fluidic seal between the shaped film and printhead.

The ink holding medium 18 is shown as three separate portions, occupying most of the chamber 11. The ink holding medium is saturated with ink and the top housing cover 27 of the same durable plastic material as the housing is placed on the housing and ultrasonically welded thereto. Referring also to FIG. 2, an exploded isometric view of the cartridge 10, the various elements of the cartridge may be viewed which forms a compact customer replaceable unit. A tube 47 extends from the vent 23 to center of the interior of chamber 11 in the housing and through openings in each of the ink holding mediums. As is well known in the industry, the printheads will have on-board circuitry for selectively activating the heating elements (not shown) of the thermal ink jet printhead 14 as addressed by electrical signals for the printer controller (not shown) which connects to the cartridge printed circuit board 44 by the cable 21 (FIG. 1) when the cartridge is installed on the carriage 15.

In the preferred embodiment, medium 18 (shown as three portions of material) is in the form of a needled felt of polyester fibers. Needled felt is made of fibers physically interlocked by the action of, for example, a needle loom, although in addition the fibers may be matted together by soaking or steam heating. According to the preferred embodiment of the present invention, the needled felt should be of a density of between 0.06 and 0.13 grams per cubic centimeter. It has been found that the optimum density of this polyester needled felt forming medium 18 is 0.095 grams per cubic centimeter. This optimum density reflects the most advantageous volume efficiency, as described above, for holding liquid ink. A type of felt suitable for this purpose is manufactured by BMP of America, Medina, N.Y.

It has been found, in order to provide the back pressure of liquid ink within the desired range, while still providing a useful volume efficiency and portability, that the polyester fibers forming the needled felt should be of two intermingled types, the first type of polyester fiber being of a greater fineness than the second type of polyester fiber. Specifically, an advantageous composition of needled felt comprises approximately equal proportions of 6 denier and 16 denier polyester fibers.

Medium 18 is packed inside the chamber 11 of housing 12 in such a manner that the felt exerts reasonable contact and compression against the inner walls. In one commercially-practical embodiment of the invention, the medium 18 is created by stacking three layers of needled felt, each one-half inch in thickness, and packing them inside the housing 12.

Also within housing 12 is a member made of a material providing a high capillary pressure, indicated as scavenger 20. Scavenger 20 is a relatively small member which serves as a porous capillary barrier between the medium 18 and the output port 16, which leads to the passageway formed by the elongated recess 30 in the chamber floor 25 and the film member 36. In the preferred embodiment of the invention, scavenger 20 is made of an acoustic melamine foam, which is felted (compressed with heat and pressure) by 50% in the direction of intended ink flow. One suitable type of melamine foam is made by Illbruck USA, Minneapolis, Minn., and sold under the trade name "Wiltec." The scavenger 20 preferably further includes a filter cloth, indicated as 22, which is attached to the reelamine using a porous hot-melt laminating adhesive. In general, the preferred material for the filter cloth 22 is monofilament polyester screening fabric. This filtered cloth provides a number of practical advantages. Typically, no specific structure (such as a wire mesh) for holding the scavenger 20 against the opening into outlet port 16 is necessary. Further, there need not be any adhesive between the filter cloth 22 and the outlet port 16. The high capillary force provided by filter cloth 22 creates a film of ink between the filter cloth 22 and the outlet port 16, by virtue of the planarity (no wrinkles or bumps) of the filter cloth 22 against the scavenger 20, the compression of the scavenger 20 against the outlet port 16, and the saturation of the scavenger 20. This film serves to block out air from the outlet port 16.

In FIG. 3, it can be seen that one portion of the outer surface of scavenger 20 abuts the ink holding medium 18, while other portions of the surface are exposed to open space 49 between the medium 18 and the inner walls of chamber 11. The single chamber 11 is so designed that a given quantity of ink may conceivably flow from the medium 18 to and through the scavenger 20, which has a higher capillarity than the medium 18, and through the filter 22, which has a higher capillarity than the scavenger, to the outlet 16 and through the passageway formed by the elongated recess and film member to the printhead inlet 34.

Figure 4:
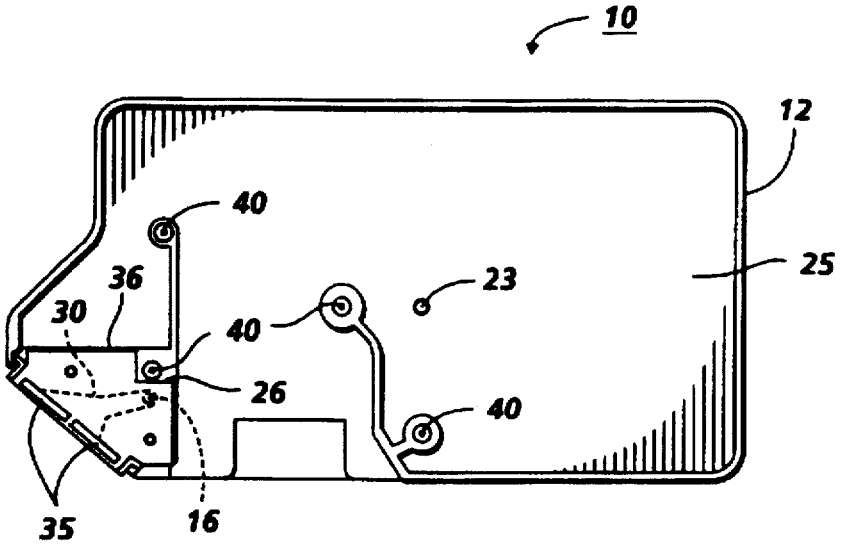
FIG. 4 is a cross-sectional plan view of the cartridge in FIG. 3 as viewed along line 4—4 therein.
Figure 5:
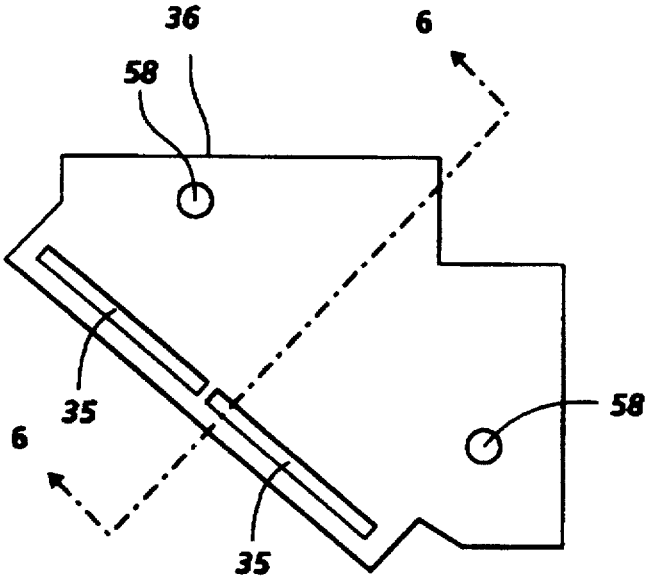
FIG. 5 is a plan view of the shaped film shown in FIGS. 2 and 3.
Figure 6:
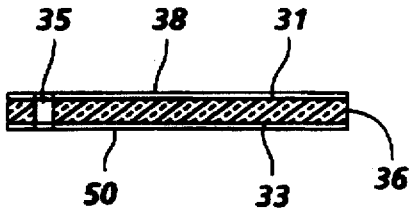
FIG. 6 is a cross-sectional view of the shaped film as viewed along section line 6—6 of FIG. 5.

FIG. 4 is a bottom view of the housing 12 as viewed along view-line 4—4, and shows the geometric shape of the film member 36 required to fit the shape of the housing floor surface 26 in this region of the housing floor 25 and to avoid stake pins 40. The film member is bonded to the surface 26 of housing floor 25 and covers the elongated recess 30 and outlet 16 connected thereto, shown in dashed line. The passageway formed by the elongated recess 30 and film member 36 terminates at the through slot 35, which is similar in size and shape as the printhead inlet 34. Thus, the passageway transitions to the relatively thin slot, so that the thermosetting adhesive 50, preferably the above mentioned bisphenol A epoxy formulation, on the film member surface 33 that surrounds the printhead inlet 34 also provides the fluidic seal between the housing and the printhead. FIG. 5 shows the film member 36 with through slot 35, and FIG. 6 is a cross-sectional view of the film member in FIG. 5 as viewed along section line 6—6, and shows the film member slot 35, holes 58 which are used by the robotic device for alignment, surface 31 with the pressure sensitive adhesive 38 thereon, and film member surface 33 with the thermosetting adhesive 50 thereon, preferably the bisphenol A epoxy formulation delineated above. Optionally, the thermosetting adhesive 50 may be used on both surfaces of the film member 36.

The selection of the adhesive used on the surfaces of the film member 36 is critical. As is evident in FIG. 3, the ink must flow against the exposed adhesive 38 on surface 31 of the film member 36. This adhesive must be resistant to chemical and erosion attack by the ink; otherwise, the ink would be contaminated by the adhesive and the ink may leak between the housing floor 25 and the film member. The adhesive 38 must be liquid enough to wet the housing floor surface 26 and the film member surface 31, but cannot be too liquid, so as to flow into the slot 35 in the film member or onto the nozzle face 42 of the printhead 14, either during or after assembly of the cartridge 10. The adhesive on film member surface 31 must also be sufficiently adhesive in nature that it does not move during or after assembly and will assist in the mechanical integrity of the cartridge. The adhesive 38 must also be tolerant of the temperatures in excess of 150° C. that are experienced as part of the encapsulation cure process. One pressure sensitive adhesive that is satisfactorily is AS-105,® a high temperature, pressure-sensitive, acrylic adhesive sold by the Adhesive Research Co. The thermosetting adhesive 50 must have substantially the same characteristics of resistance to chemical and erosion attack by the ink and controlled flowability to prevent flow into film member slot 35 and printhead inlet 34 and onto the nozzle face 42.

The working life of the bisphenol A epoxy formulation is about 48 hours if maintained at a temperature of 10° C. This temperature may be maintained by, for example, providing a cooling jacket around a dispensing syringe (not shown). The overall pot life of the epoxy formulation 50 is in excess of 30 days, if the epoxy formulation is frozen. The bonding strength in the presence of high PH thermal ink jet inks is very high and is believed to be due to a reaction between the adhesive promoter and water in the inks. Thus, the bisphenol A epoxy formulation provides the needed qualities of dispensability with time by a syringe, curing at temperature suitable for other materials used in the fabrication process for the cartridge, high strength bonding to assume a fluidic seal around the printhead inlet, and ink compatibility.

Many modifications and variations are apparent from the foregoing description of the invention and all such modifications and variations are intended to be within the scope of the present invention.

We claim:

1. A liquid ink supply cartridge for an ink jet printer having a printhead with nozzles in communication with an ink inlet of predetermined size, comprising:

a housing having a chamber, the chamber having a vent and a floor with an outlet therethrough, the floor having internal and external surfaces, the chamber being substantially filled with liquid ink;

an elongated recess in the external surface of the chamber floor connected at one end to the chamber floor outlet;

a film member having a predetermined shape and a slot therethrough being mounted on the external surface of the chamber floor at a predetermined location, the slot being substantially the same size as the printhead inlet, the shaped film member having first and second surfaces, each film member surface having an adhesive coated thereon, the shaped film member first surface being bonded to the external surface of the chamber floor by the adhesive thereon and over the chamber outlet and elongated recess to form an ink passageway from the chamber outlet to the film member slot; and the printhead being fixedly attached to the external surface of the housing chamber floor at a location so that the printhead inlet is aligned with the film member slot and the printhead is bonded to the film member by the adhesive on the second surface thereof, the adhesive on the second surface of the film member serving as the seal around the printhead inlet and, wherein the adhesive on the second surface of the film member is a thermosetting adhesive comprising a bisphenol epoxy A with curing agent and adhesive promoter, said adhesive being resistant to attack by the ink and wherein the bisphenol epoxy A and curing agent formulation is:

(a) 30:70 solvent mixture by weight with methyl isobutyl ketone and xylene;

(b) 1 001 F.® resin;

(c) V40® curing agent;

(d) 1:3 ratio of curing agent to resin;

(e) 1:3 ratio of solvent mixture to curing agent; and wherein the adhesion promoter is polymeric dimethoxy methylpropylsilane, which is applied to surfaces to be bonded prior to application of above mixture of bisphenol epoxy and curing agent.

2. The ink supply cartridge of claim 1, wherein the adhesive on the first surface of the film member is a pressure sensitive adhesive which is not soluble in constituent components of the ink.

3. The ink supply cartridge of claim 1, wherein the adhesive on the first surface of the film member is the same thermosetting adhesive as is on the second surface of the film member, the bisphenol epoxy A, curing agent, and adhesion promoter not being soluble in constituent components of the ink.

4. The ink supply cartridge of claim 3, wherein the vent is in the chamber floor.

5. The ink supply cartridge of claim 4, wherein the chamber is substantially filled with a liquid holding medium having a predetermined capillarity and the ink in the chamber being absorbed in the medium.

6. A film member for an ink supplying cartridge of the type used for supplying ink to an ink inlet in a printhead for an ink jet printer, the film member being used to form a passageway from an ink outlet in the cartridge to the printhead inlet by covering an elongated recess in a surface of the cartridge which is connected at one end to the cartridge outlet, the film member comprising:

a polyester film having a predetermined shape and an elongated slot therethrough at a predetermined location therein, the film having first and second surfaces, each surface being coated with an adhesive, the adhesive on the first surface being a type which is not affected or attacked by the ink, the film being bonded to the cartridge surface to cover the cartridge outlet and recess by the adhesive on the first surface of the film with an elongated slot in communication with the passageway, the printhead being bonded to the second surface of the film by a thermosetting epoxy adhesive thereon with the printhead inlet being aligned with the film elongated slot, whereby the adhesive on the second surface of the film serves also as a seal for the printhead inlet and, wherein the epoxy adhesive is a mixture of bisphenol epoxy A and curing agent; and wherein the surfaces to be adhered together by said bisphenol epoxy and curing agent mixture is first coated with an adhesion promoter and wherein the bisphenol epoxy A and curing agent formulation is:

(a) 30:70 solvent mixture by weight with methyl isobutyl ketone and xylene;

(b) 1 001 F.® resin;

(c) V40® curing agent;

(d) 1:3 ratio of curing agent to resin;

(e) 1:3 ratio of solvent mixture to curing agent; and wherein the adhesion promoter is polymeric dimethoxy methylpropylsilane, which is applied to surfaces to be bonded prior to application of above mixture of bisphenol epoxy and curing agent.

7. The film member of claim 6, wherein the adhesive on the first surface of the first member is a pressure sensitive adhesive.

8. The film member of claim 6, wherein the adhesive on the first surface of the film member is the same bisphenol epoxy A, curing agent, and adhesion promoter as used on the second surface of the film member.

* * * * *